United States Patent [19]

Beutler et al.

[11] 4,432,703

[45] Feb. 21, 1984

[54] ADJUSTING ARRANGEMENT FOR A HYDRAULIC PUMP WITH VARIABLE DISCHARGE FLOW QUANTITY

[75] Inventors: Gerhard Beutler, Nagold; Heinz Berthold, Horb; Joachim Morsch, St. Wendel; Karl Schiene, Sulzbach, all of Fed. Rep. of Germany

[73] Assignee: BSO Steuerungstechnik GmbH Industriestrasse, Fed. Rep. of Germany

[21] Appl. No.: 318,064

[22] Filed: Nov. 4, 1981

[30] Foreign Application Priority Data

Nov. 26, 1980 [DE] Fed. Rep. of Germany ..... 3044515

[51] Int. Cl.[3] ..... F04B 1/26

[52] U.S. Cl. ..... 417/217; 417/218

[58] Field of Search ..... 417/218, 222, 219, 220, 417/221, 217; 91/506

[56] References Cited

U.S. PATENT DOCUMENTS 3,750,534 8/1973 Leutner et al. ..... 417/217 X
3,788,775 1/1974 Leutner et al. ..... 417/222

FOREIGN PATENT DOCUMENTS 1528434 7/1965 Fed. Rep. of Germany .
2045405 9/1970 Fed. Rep. of Germany .
2062368 12/1970 Fed. Rep. of Germany .
2313853 3/1973 Fed. Rep. of Germany .

*Primary Examiner*—Edward K. Look
*Attorney, Agent, or Firm*—Scully, Scott, Murphy & Presser

[57] ABSTRACT

An adjusting arrangement for a hydraulic pump with a variable flow quantity, having an operating cylinder located in a neutral position through the intermediary of a positively-acting resetting device, the piston of which is adjustable dependent upon the actual discharge pressure and dependent upon a parameter proportional to the actual discharge flow quantity into a position corresponding to the rated discharge flow quantity with consideration being given to the limiting value for maximum power output, maximum discharge pressure, maximum discharge flow quantity and, as required, the flow direction. An electronic control arrangement receives electrical signals corresponding to the rated discharge flow quantity and the actual discharge flow quantity and the actual pressure, which processes these signals under calculation of the actual power output and the actual pressure, and generates corresponding setting signals for the adjustment of the operating cylinder.

16 Claims, 8 Drawing Figures

ADJUSTING ARRANGEMENT FOR A HYDRAULIC PUMP WITH VARIABLE DISCHARGE FLOW QUANTITY

BACKGROUND OF THE INVENTION

1. Field of the Invention

The present invention relates to an adjusting arrangement for a hydraulic pump with a variable flow quantity, having an operating cylinder located in a neutral position through the intermediary of a positively-acting resetting device, the piston of which is adjustable dependent upon the actual discharge pressure and dependent upon a parameter proportional to the actual discharge flow quantity into a position corresponding to the rated discharge flow quantity with consideration being given to the limiting value for maximum power output, maximum discharge pressure, maximum discharge flow quantity and, as required, the flow direction; and with an electronic control arrangement which receives electrical signals corresponding to the rated discharge flow quantity and the actual discharge flow quantity and the actual pressure, which processes these signals under calculation of the actual power output and the actual pressure, and generates corresponding setting signals for the adjustment of the operating cylinder.

Hydraulic pumps with adjustable discharge quantities are, in general, equipped with mechanical or electromechanical adjusting arrangements. By means of these the hydraulic pumps should be correlated with the present purpose of the utilization, whereby there are to be maintained the limits with regard to the maximum discharge flow quantity, the maximum discharge pressure, as well as the maximum power output. The power output of a hydraulic pump is determined through N-discharge flow quantity multiplied by the discharge pressure. Within the plane of the discharge quantity/discharge pressure there is accordingly produced a hyperbola. The range of the power achievable through the hydraulic pump is restricted by the parameters (compare with FIG. 3), wherein this is applicable to both discharge flow directions. For the practical case of application this signifies that within the pump operating circuit there must be provided an adjusting arrangement which restricts the maximum permissible pressure of the pump. The maximum possible discharge flow quantity of the pump is limited through the discharge volume thereof and the permissible rotational speed. At a given discharge flow quantity, the operating pressure of the hydraulic pump can thus be raised up to the power output curve. When a hydraulic pump is to be operated at a constant power output, then the discharge flow quantity must be correspondingly varied by means of the adjusting arrangement.

2. Discussion of the Prior Art

For the operation of the pump within the mentioned power output range there has become known an adjusting arrangement of the above-mentioned type from German Laid-open Patent Application 23 13 853. The known adjusting arrangement contains an impact plate system in which the impact plate is adjusted in conformance with a rated value, whereby the adjustment is effected through an electrical calculator which considers the actual discharge pressure and the limiting value for discharge flow quantity. The discharge flow quantity-actual/rated-value comparison is effected pneumatically in such a manner that the two chambers of the operating cylinder presently power one nozzle whose jets impinge against the impact plate. The maximum value of the discharge pressure is given consideration through a safety relief valve. Thus there is contended that this adjustment can also be effected in an electrical mode, however, it is not indicated as to how that type of an electrical adjustment can be achieved. It is disadvantageous in the known adjusting device that there must be effected an individual correlation of the essentially mechanical adjusting arrangement to the different constructional pump sizes, which means that, for each pump size, there must be provided its own adjusting arrangement and also correlated therewith. Constructional tolerances within a pump size can also not be taken into consideration. This means that the power output which stands available cannot be fully utilized. Any change in the power output curve in comparison with the maximum possible power output curve is not possible without an exchange of the mechanical arrangement. Thus, a precise reproducability for each hydraulic pump associated power curve is not possible.

In another known adjusting arrangement for a hydraulic pump with a variable discharge flow quantity as disclosed in German Laid-open Patent Application 20 45 405, the control of the adjustment of the piston within the operating cylinder is effected in an electrical manner through control of the electromagnets of a servovalve, however, the known adjusting arrangement is constructed only for the time-dependently controlled adjustment of the piston between its end positions. Through this adjusting arrangement the hydraulic pump can thus not be operated with a suitably preselectable power output.

SUMMARY OF THE INVENTION

Accordingly, it is an object of the present invention to so construct an adjusting arrangement of the above-mentioned type wherein it is basically applicable to different constructional pump sizes, whereby the power output curve should be precisely reproduceable.

The foregoing object is inventively achieved in a hydraulic pump pursuant to present type in that the signal which is proportional to the actual discharge flow quantity conforms to the angle of traverse of the hydraulic pump, in that the input parameters of the electronic control arrangement are currently standardized with reference to the maximum permissible value, and that the limiting values associated with each operating condition are introducable from externally into the electronic control arrangement in the form of electrical signals.

A particular advantage of the invention lies in that in a simple manner, leakage losses which occur with increasing discharge pressure can be compensated through a correcting signal. A further important advantage consists of in that, also in a simple manner, there can be eliminated the difficulties which would occur for small actual discharge flow quantities with the usual regulation of the discharge pressure. This is effected simply by means of a net-angle traverse limiter. It is to be mentioned that the above-mentioned known adjusting arrangement has recognized these difficulties, however considers these in a completely different manner, in essence in that between a preset discharge pressure below the maximum discharge pressure, with this there is limited the power output along another steeper power output curve.

Accordingly, it is an important aspect of the invention that the hydraulic pump can be operated within a range of presettable boundary values insofar as these lie within the power output range determined by the boundary values of the pump or operating drive engine. The rated values and the boundary values can hereby be selectively introduced manually or from an externally programmable control. Since additionally, there must merely be actuated an arrangement which conveys an adjusting medium to the operating cylinder by means of electrical signals, the entire adjusting arrangments can also be utilized in a location in which the hydraulic pump must operate explosion-proof in an explosion-endangered environment, since merely measuring signals for the rated values and adjusting signals for this control arrangement must be conveyed into the explosion-endangered area.

BRIEF DESCRIPTIONS OF THE DRAWINGS

Reference may now be had to preferred embodiments of the invention, taken in conjunction with the accompanying drawings; in which:

FIG. 1 schematically illustrates a hydraulic pump equipped with an adjusting arrangement pursuant to the invention;

FIG. 2 diagrammatically illustrates the control characteristics of the hydraulic pump;

FIG. 3 diagrammatically illustrates the control characteristics of the hydraulic pump;

DETAILED DISCRIPTION

Figure 1:
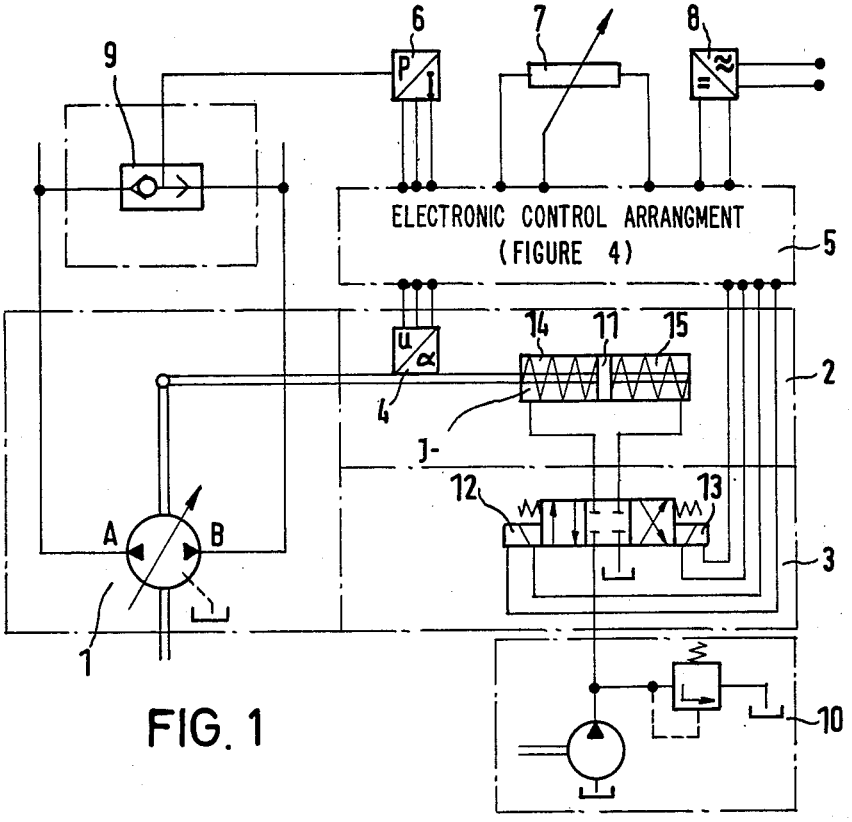
Figure 2:
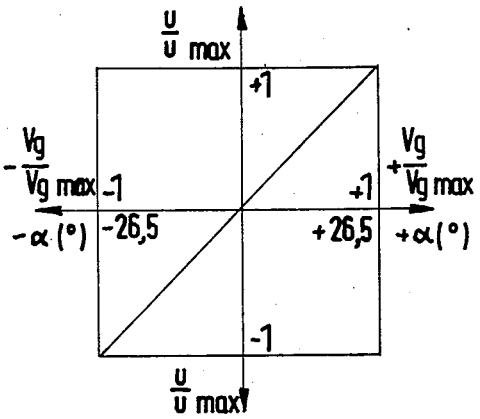

In FIG. 1, an axial piston pump is represented as a hydraulic pump 1, which includes two discharge flow directions A and B. The adjustment of the discharge flow quantity for the hydraulic pump 1 is effected through angular displacement by means of an operating cylinder 2. The setting of the piston 11 of the operating cylinder 2 is effected in the illustrated exemplary embodiment by means of 4/3 displacement proportionating valve 3 in such a manner that, dependent upon the powering of the proportionating magnets 12 or 13 of the displacement proportionating valve 3, there is introduced an adjusting fluid for the settings of the piston 11 of the operating cylinder into one of the two cylinder chambers 14 and 15, or to neither of these chambers. The infeed of the adjusting fluid is effected by means of a control pump 10 with a pressure safety device of usual construction. The signals for the excitation of the proportionating magnets 12, 13 are generated by an electronic control arrangement 5 which takes into consideration through an actual value indicator 6 the actual discharge pressure in the discharge circuit of the hydraulic pump 1, through an angle of traverse indicator 4 on the pivot axis of the hydraulic pump the actual discharge flow quantity of the hydraulic pump, as well as through a schematically illustrated rated value and boundary value indicator 7 the rated values and boundary values. The electronic control arrangement 5 is supplied through a power network apparatus 8. Inasmuch as only one actual pressure indicator 6 can be employed for a hydraulic pump one with two discharge directions A and B, there is additionally provided an alternating valve 9 between the two discharge conduits of the hydraulic pump 1.

The operating cylinder 2 sets the discharge flow quantity of the hydraulic pump 1 in dependence upon a rated value introduced through the indicator unit 7, wherein the electronic control arrangement 5 compares the signal corresponding to the rated value with the actual values under consideration of the introduced limiting values and boundary value.

Figure 4:
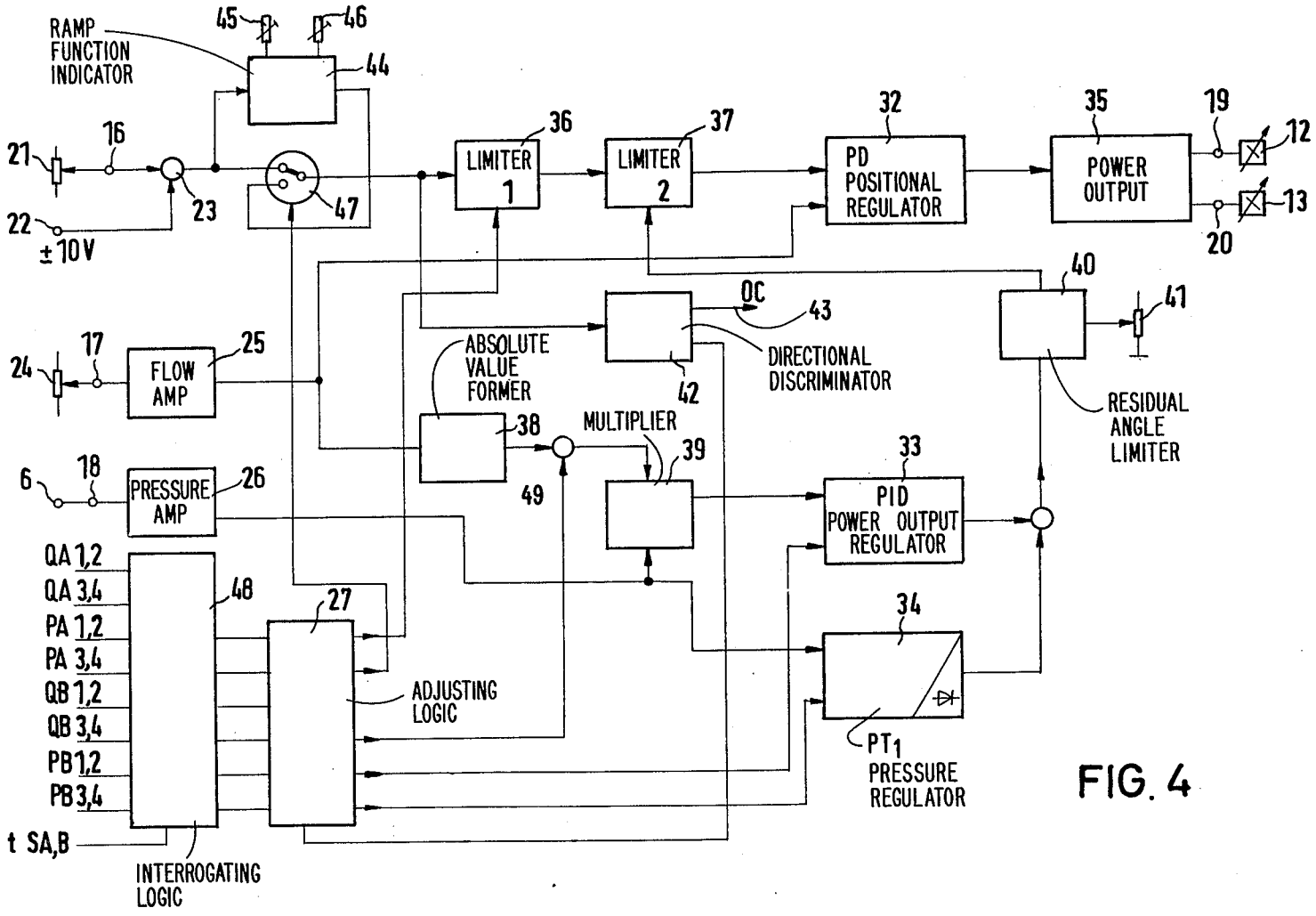
FIG. 4 illustrates a schematic block circuit diagram of the electronic control arrangement.

FIG. 4 illustrates a circuit block diagram of the electronic control arrangement 5. The electronic control arrangement 5 includes an input 16 for a signal corresponding to the rated value of the discharge flow quantity, an input 17 for a signal corresponding to the actual discharge flow quantity, an input 18 for a signal corresponding to the actual discharge pressure, an output 19 for initiating a control signal for the proportionating magnet 12, and an output 20 for initiating control of the proportionating magnet 13. A rated value indicator, which is schematically illustrated as a potentiometer 21, is connected with the input 16 through which there is adjustable the rated discharge flow quantity between a maximum value and a minimum value, or respectively, a maximum value for one discharge direction and a maximum value for the other discharge direction. The selection of the discharge direction can, however, also be effected independently through a separate input. The rated value signal can also be introduced normalized or standardized through an input 22 and a selector element 23 between two voltage levels. As previously mentioned, the signal corresponding to the actual discharge flow quantity is tapped off from the angle of traverse of the pivot axis of the hydraulic pump 1. This is suitably effected by means of a potentiometer 24 fastened on the pivot axis. The signal corresponding to the actual discharge flow quantity conducted to the input 17 from the potentiometer 24 is normalized by means of an amplifier 25 and, in effect, with regard to the rated discharge power output, in effect, with the still to be determined boundary value of the power output. In the same manner, the signal corresponding to the actual discharge pressure conducted to the input 18 from the discharge pressure indicator 6 is normalized through an amplifier 26 with regard to the rated value of the discharge pressure, respectively, the still to be determined boundary value of the discharge pressure. Through the normalization there is achieved that the adjusting arrangement for the hydraulic pump 1 can be independent of the constructional size thereof. This is further also achieved in that the angle of traverse of the pivot axis is utilized as a measure for the discharge flow quantity, since this angle of traverse is independent of the constructional size of the hydraulic pump 1.

Figure 3:
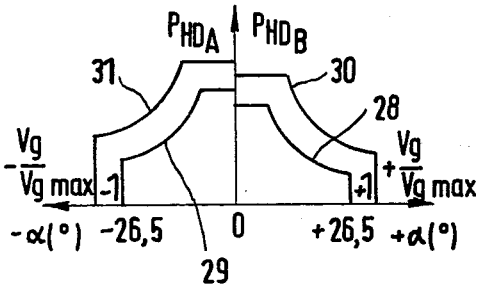

The rated value and the boundary value indicator unit 7, however, does not only evidence the rated value inputs 21, 22, but also a focusing area 27, in which there can be set in a digital or analogue mode by means of level switches or potentiometers, maximum values for the discharge flow quantity, the discharge power output and the discharge pressure, which hereinbelow are designated as boundary values. It is to be mentioned that the absolute boundary values for the discharge pressure and the discharge flow quantity are predetermined by the hydraulic pump, wherein the boundary value for the discharge pressure is in the usual manner considered by a safety relief valve. However, for the invention is essential that boundary values, which are lower that these absolute boundary values, can be preselected such a manner that, referring to FIG. 3, there can be preselected power output curves 28, 29 which lie within the maximum possible power output range, which is predetermined by the power output curves 30 or 31. Through the normalization of the parameters introduced to the electronic control arrangement 5, it is possible to achieve the setting of these boundary values in a simple manner.

Pursuant to FIG. 4, the electronic control arrangement 5 contains as essential elements a PD positional regulator 32, a PID power output regulator 33, and a $PT_1$ pressure regulator 34. The PD positional regulator 32 provides in dependence upon a comparison between the rated discharge flow quantity and the (normalized) actual discharge flow quantity, a regulating deviating signal which controls the dependently-prescaled corresponding power output end steps 35 which, in turn, through the outputs 19 or 20 transmit adjusting signals to the proportionating magnets 12 or 13. The power output end steps 35 are suitably constructed as chopper end steps.

By means of a first limiter 36 there is hereby restricted the signal corresponding to the rated discharge flow quantity to a boundary value introduced through focusing area 27. Through the intermediary of a second limiter 37 this signal is further restricted with regard to the maximum power output through the PID power output regulator 33 and with regard to the maximum pressure through the $PT_1$, pressure regulator 34. This means that the operation of the hydraulic pump 1 is restricted to the range within the preselected curves 28 or 29 pursuant to FIG. 3. The PID power output regulator 33 compares a signal corresponding to the actual power output with a signal corresponding to the maximum power output from the focusing area 27. Since the power output regulator 33 is constructed as a PID regulator, it is in a position at optimum correlation to follow the power output curve corresponding to the mathematical model. The power output regulator 33 is more closely elucidated hereinbelow. The actual power output is not directly determined but is calculated from the actual discharge flow quantity and the actual discharge pressure. For this purpose, the normalized signal corresponding to the actual discharge flow quantity is conducted to an absolute value former and then to a multiplier 39 for the unrestricted multiplication with the normalized signal conforming to the actual discharge pressure, which is transmitted to the other input of the multiplier 39. The power output is essentially proportional to the product of the discharge pressure and discharge flow quantity. Since normalized parameters are utilized for the discharge pressure and discharge flow quantity, the signal corresponding to the discharge power output is also a normalized signal and can thereby be compared with the maximum value of the power output without transformation.

Figure 5:
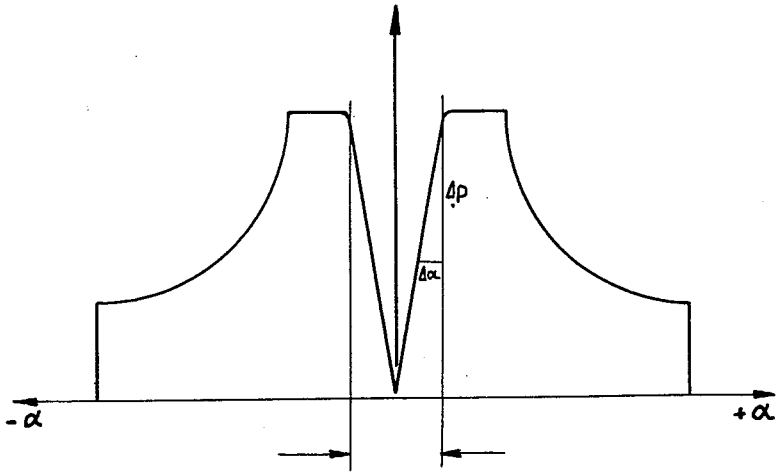
FIG. 5 illustrates the pressure relationship within the range of smaller discharge flow quantities.

The pressure regulator 34, which is constructed as a $PT_1$ regulator, compares the (normalized) actual discharge pressure with the maximum discharge pressure and generates a corresponding output signal. The different construction of the different regulators 32, 33, 34 hereby takes into consideration the extremely different relationship of the control paths during the different types of operation, which means during the operation of the hydraulic pump 1 along the different curve segments of the power output curves 28, 29. At extremely small discharge flow quantities, corresponding to extremely small angles of transverse in which there naturally reigns a pressure regulation pursuant to the type of operation (refer to FIG. 5), there is produced an extremely high circuit amplification since the ratio of $\Delta P/\Delta P2$ is extremely high in this range. Since on the other hand, the adjusting arrangement equipped with proportionating magnets 12 and 13 operates relatively slowly, the behavior of the hydraulic pump 1 within this range would be unstable. In the event that such ranges are important, accordingly there must be utilized a servovalve control in lieu of the proportionating magnet control, which would be extremely expensive. In order to be able to utilize the inexpensive proportionating magnets, by means of a residual angle limiter 40 (FIG. 4), the pressure regulation within the range of small angles of traverse or small discharge flow quantities, is rendered inoperative. The excess pressure increase which is then produced within this range is prevented through the utilization of a (small) pressure limiting valve (not shown). The residual angle limitation is optimally adjustable by means of an internal potentiometer 41.

Furthermore, there is provided a directional discriminator 42 which provides information over the discharge flow direction of the hydraulic pump 1. For this purpose, a corresponding output signal is conducted to the focusing area 27. For an applicable further utilization there can be provided an additional connection 43, for example, a socalled open-collector-connector, conducted, for example, to a terminal bar. FIG. 4 further illustrates a ramp function indicator 44 with which there is associated a variable potentiometer 45 for the discharge direction A and a variable potentiometer 46 for the discharge direction B, through which there can be set the current tilt of a ramp. The ramp can be switched together through an interrogating input, for delaying of the actual value changes. Thereby, it is possible to influence the pivot time period of the pump.

Naturally, in lieu of a ramp function indicator 44 there can also be utilized a sinus function indicator, a square-wave function transmitter, or the like. This indicates that a programmed control is possible.

Finally, FIG. 4 also discloses an interrogating logic 48 which is associated to the adjusting field 27, and by means of the boundary values in the different quadrants of the power output curve (FIG. 3), in essence, the boundary values of the power output curve for the different discharge direction A and B can be differently set whereby the focusing area 27 dependent upon the output signal of the directional discriminator 42 will transmit the current boundary value to the first limiter 36, the PID power output regulator 33 or the $PT_i$ pressure regulator 34.

The interrogating logic 48 can be also be constructed that by means of a program or the like, the boundary values can be varied so as to render a program control achievable.

Figure 8:
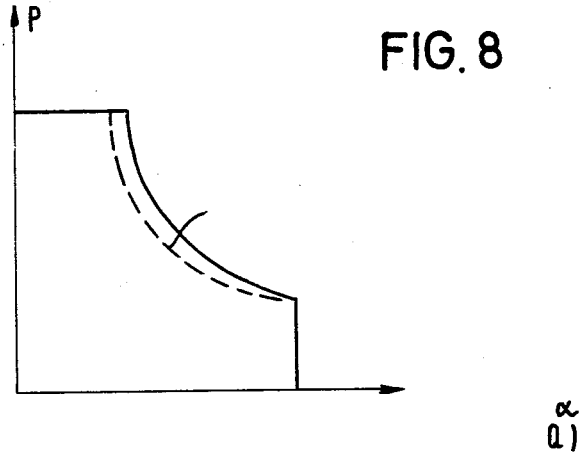
FIG. 8 diagrammatically illustrates the principle of the compensation relative to leakage losses.

Hydraulic pumps basically have the property that with an increasing operating pressure the internal leakage flows will increase. The internal leakage flows also increase with increasing wear. Through these leakage flows there is adversely affected the efficiency of the power output. The control arrangement 5 pursuant to FIG. 4, in consideration of the leakage flows, includes an adder 49 between the absolute value former 38 and multiplier 39 to which there is conducted, on the one side, the normalized absolute value of the actual discharge flow quantity and, on the other side, a correcting factor from the focusing area 27. This correcting factor is associated with the current boundary characteristics and is automatically interrogated therewith. In this manner the emitted power output can be rendered independent of the leakage oil influence, particularly in that there is added thereto the correcting factor in the adder 49. Also the input power can be rendered extensively independent of leakage oil influence and, in essence, in that a corresponding correcting factor is subtracted. This addition or subtraction of a (essentially constant) correcting value to the absolute value of the discharge flow quantity, or the angle of traverse effects a parallel displacement of the hyperbolic curve corresponding to the power output relative to the ordinate, as illustrated in FIG. 8 by a phantom line.

The PID power output regulator 33 preferably consists on its input side of a differentiating former in which there is determined the regulating deviation, having connected to the output thereof a PD regulator, wherein an I-regulator is connected in parallel therewith. The two regulator components are combined in a summing location, wherein the sum is conducted to an ideal rectifier which operates in such a manner that the second limiter 37 has an adjusting signal conducted thereto only when the set maximum power is exceeded, in essence when the power output regulator 33 must be activated. An exemplary embodiment of the I-regulator is illustrated in FIG. 6, wherein the transitional behavior thereof is illustrated in FIG. 7.

Figure 6:
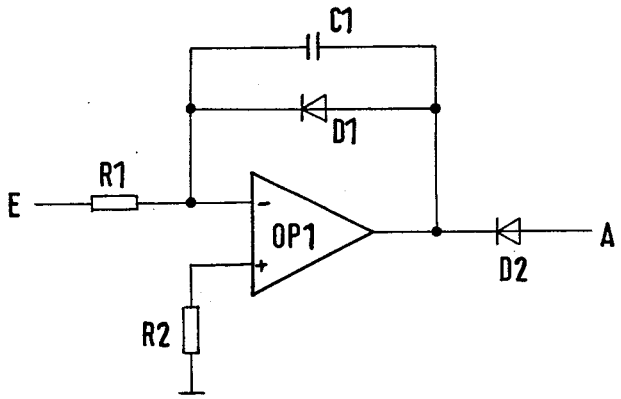
FIG. 6 illustrates the construction of an I-regulator for utilization in the power output regulator pursuant to FIG. 4.
Figure 7:
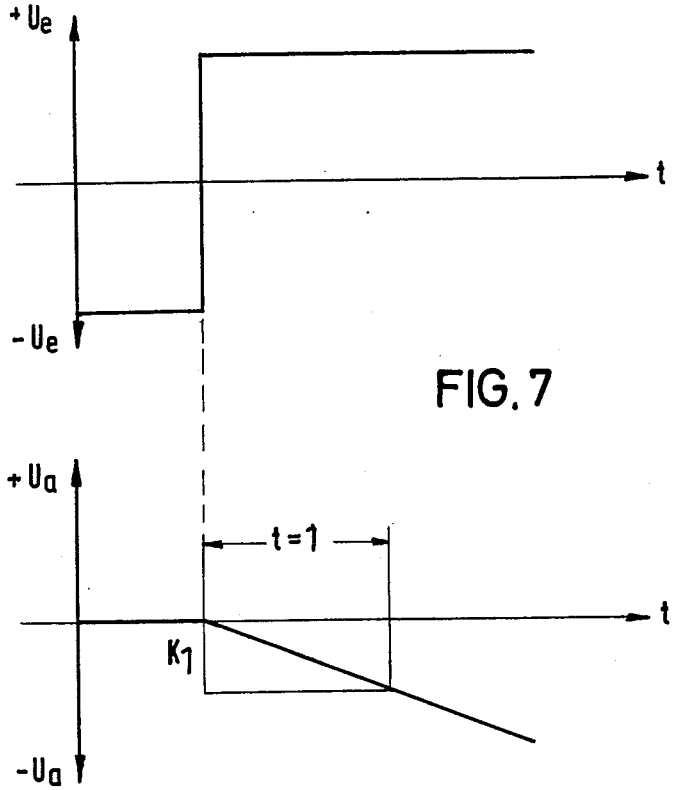
FIG. 7 illustrates the transitional behavior of the I-regulator pursuant to FIG. 6.

FIG. 6 illustrates an operational amplifier OPI in the inverse feedback circuit of which there is arranged a parallel circuit formed of a first diode DI and a condenser C1 and at whose output there is provided a diode D2 which is switched in the blocking direction. Resistors R1 and R2 serve for correlation. The operational amplifier OPI is thereby so connected that at positive input voltages corresponding to an exceeding of the rated power output there is achieved the function of a normal integrator. In this case the diodes D1 and D2 are compensated through the inverse feedback circuit and are without significance to the transitional behavior. For negative input voltages E corresponding to dropping below the rated power output, through the second diode D2 there is prevented a positive output voltage A. The first diode D1 achieves an additional inverse backfeed by means of which there is avoided that the operational amplifier OPI is set to its limiting position. Suppressed thereby is the influence of the leakage current of the diode D2 on the output sigal A. The output voltage A of the operational amplifier OPI is thus restricted for positive input voltages to about the gating or threshold voltage of the first diode D1. At negative input voltages there is reached the function of an ideal diode.

An important advantage of the inventive adjusting arrangement lies in that the electronic control arrangement 5 can be located independently of the positional arrangement of the hydraulic pump 1 and the operating cylinder 2. Achieved hereby, in a simple manner, is an explosion-proof protection so that the inventive adjusting arrangement can also be utilized in explosion endangered area without additional requirements.

A further feature of the inventive adjusting arrangement consists of in that the extremely differing technical control behaviors of the regulating section (for example, the hydraulic pump 1) are considered for the different regulating operating types (pressure regulation, discharge flow quantities or angle of traverse regulation, and power output regulation) within the electronic control arrangement 5 and, upon need there is effected an automatic actuation. Through the normalization or standardization of the actual values by means of the correlating amplifiers 25 and 26, the actual values become independent of the pump size or type of pump construction so that the adjusting arrangement can basically have the same dimensions for all types of pump constructions.

It is to be mentioned that the adjustment of the operating cylinder 2 need not necessarily be effected by a means of a 4/3 path proportionating valve 3, but can also be effected by means of a servovalve. In the last-mentioned instance the end step 5 is constructed in a correspondingly different manner.

What is claimed is:

1. An adjusting arrangement for a hydraulic pump having a variable discharge flow, said arrangement comprising:

(a) a first means for adjusting the angle of traverse for said pump to vary the discharge flow of said pump, said first means responsive to a variable pilot pressure;

(b) a first control means for translating electronic control signals to variable pilot pressure signals for said first means;

(c) an electronic control means, said electronic control means having:

(i) a means for generating a signal proportional to the angle of traverse of said pump representing an actual discharge flow quantity;

(ii) a means for normalizing input parameters of said electronic control means with respect to a predetermined set of maximum permissible values said input parameters including a rated discharge flow quantity, said actual discharge flow quantity, and an actual discharge pressure;

(iii) a means for introducing boundary values to said electronic control means;

(iv) a regulator means for generating said electronic control signals provided to said first control means, said regulator means deriving said electronic signals from said angle of traverse signal, said normalized input parameters and said boundary values.

2. Adjusting arrangement as claimed in claim 1, said boundary values for first and second discharge flow directions of the pump being separately introduceable, and a discharge flow direction discriminator being contained in said electronic control means.

3. Adjusting arrangement as claimed in claim 2 comprising a discharge flow directional signal being conducted outwardly from said flow direction discriminator.

4. Adjusting arrangement as claimed in claim 1 or 2, comprising means for effecting a normalization relative to a current rated value and said boundary values.

5. Adjusting arrangement as claimed in claim 1, comprising means for introducing a time dwell period for pivoting of the angle of traverse of the hydraulic pump into said electronic control means.

6. Adjusting arrangement as claimed in claim 1, said input parameters being digitally introduced into said electronic control means externally thereof.

7. Adjusting arrangement as claimed in claim 1, comprising an adjustable limiter in said electronic control means for the minimum discharge flow quantity, said limiter being effective to prevent dropping below a set minimum discharge flow quantity during regulation.

8. Adjusting arrangement as claimed in claim 1, comprising a correcting element in said electronic control means for varying the value of an actual discharge flow quantity signal to compensate for leakage oil losses at increasing discharge pressures.

9. Adjusting arrangement as claimed in claim 8, said correcting element adding a correcting value to a discharge power output signal to compensate for leakage oil losses.

10. Adjusting arrangement as claimed in claim 8, said correcting element subtracting a correcting value from the input parameters to compensate for the leakage oil losses.

11. Adjusting arrangement as claimed in claim 1, said electronic control means including; a multiplier providing an output signal conducted to said regulator means as an actual value, said multiplier receiving as input signals for calculating the actual power output, signals proportional to the actual discharge flow quantity, the actual discharge pressure, and having the corresponding signal introduced thereto as a rated value.

12. Adjusting arrangement as claimed in claim 11, wherein said regulator means comprises a PID power output regulator, a differentiating former, a PD regulator connected to the output of the former and an I-regulator connected in parallel with said PD regulator, each having their regulating signals added together.

13. Adjusting arrangement as claimed in claim 12, said PID power output regulator emitting an output signal only upon reaching of the boundary value for the discharge power output signal.

14. Adjusting arrangement as claimed in claim 12, said I-regulator comprising an operational amplifier having a parallel circuit including a condenser and a first diode in an inverse backfeed circuit and a second diode in a blocking direction in an output conductor.

15. Adjusting arrangement as claimed in claim 1, wherein said boundary values are externally introduceable, and may be variably predetermined by an external program control.

16. Adjusting arrangement as claimed in claim 15, said introduceable values being manually selectable.

* * * * *

UNITED STATES PATENT AND TRADEMARK OFFICE

CERTIFICATE OF CORRECTION

PATENT NO. : 4,432,703

DATED : February 21, 1984

INVENTOR(S) : Gerhard Beutler, et al

It is certified that error appears in the above-identified patent and that said Letters Patent is hereby corrected as shown below:

Column 6, line 56 "or the $PT_i$" should read --or the $PT_1$--.

line 57 "can be also be " should read --can be also so--.

Column 7, line 53 "sigal" should read --signal--.

Signed and Sealed this

*Twenty-first* Day of *August 1984*

[SEAL]

*Attest:*

GERALD J. MOSSINGHOFF

*Attesting Officer*

*Commissioner of Patents and Trademarks*